US005829172A

United States Patent [19]

Kaneko

[11] Patent Number: 5,829,172

[45] Date of Patent: Nov. 3, 1998

[54] SHOE SOLE FOR RUNNING SHOES

[75] Inventor: Yasunori Kaneko, Osaka, Japan

[73] Assignee: Mizuno Corporation, Osaka, Japan

[21] Appl. No.: 664,016

[22] Filed: Jun. 13, 1996

[30] Foreign Application Priority Data

Jun. 14, 1995 [JP] Japan ..... 7-172931

[51] Int. Cl.[6] ..... A43B 5/06

[52] U.S. Cl. ..... 36/108; 36/129

[58] Field of Search ..... 36/108, 107, 129, 36/67 R, 67 A, 148, 149, 76 R, 128

[56] References Cited

FOREIGN PATENT DOCUMENTS

| | | |
|---|---|---|
| 2-98703 | 8/1990 | Japan . |
| 5-63308 | 8/1993 | Japan . |
| 5-72801 | 10/1993 | Japan . |
| 6-24505 | 4/1994 | Japan . |

OTHER PUBLICATIONS

Abstract of WIPO Publucation No. 88/08263, published Nov. 3, 1988.

*Primary Examiner*—Ted Kavanaugh

*Attorney, Agent, or Firm*—Evenson, McKeown, Edwards & Lenahan, PLLC

[57] ABSTRACT

The present invention relates to the shoe soles of running shoes, particularly to running shoes used in sports in which bursts of speed are required, e.g., the 100-meter footrace or the approach run for the long jump. The object of the invention is to prevent the heel from touching ground during running and thereby prevent a decrease in running efficiency. A shoe sole for running shoes, therefore, has a forefoot portion which is thickly formed so as to allow for fixing of spikes. Behind the forefoot portion, a reinforcing member is provided to fill the region between the ground contact plane which is the same as the forefoot portion and the bottom surface of the last. A lateral rib and a medial rib are provided to the arch region. The lateral rib possesses a gradually inclined plane, the range thereof beginning from the rear edge portion of the reinforcing member provided to the ball region and extending to the front edge portion of the heel region. The medial rib possesses a gradually inclined plane, the range thereof beginning from the rear edge portion of the reinforcing member provided to the ball region and extending to the front edge portion of the heel region.

9 Claims, 12 Drawing Sheets

SHOE SOLE FOR RUNNING SHOES

FIELD OF THE INVENTION

The present invention relates to shoe soles of running shoes, particularly to running shoes used in such sports where bursts of speed are required, e.g., the 100 meter race or the approach run for the long jump (such sports will hereafter be referred to as "sprint events").

DESCRIPTION OF RELATED ART

Generally, the state of bodily movement, i.e. the state of the foot striking the ground during running, has been thought to be according the series of motion as follows: first, the heel strikes the ground, following which the lateral ball portion lands, and then the motion transfers to the medial ball portion, so that the entire ball portion and the shoe toe portion has contacted and enters the acceleration phase, and takes off from the ground from the toe portion; accordingly, running shoes have been provided in accordance with the aforementioned state.

However, the state of bodily movement, i.e. the state of the foot and bodily center of gravity striking the ground in the event of running in sprint events, is not the same as the aforementioned state of bodily movement striking the ground when running, but rather, a method of running is employed wherein the heel does not strike the ground during fast running, whereby records can be increased by means of minimizing the degree of the heel striking the ground during fast running. However, in the latter half of the short-distance race, the degree of the heel dropping increases due to fatigue, whereby the speed of running is decreased. In order to deal with this, running shoes have been provided with a function to prevent the heel from dropping. One example thereof is "Running shoes" as described in Japanese Patent Publication No. 5-72801.

This invention is comprised of a total of 6 claims, necessarily involving a wedge-shaped structure which is in continuation with the forefoot portion of the shoe sole and ground-contact plane of the aforementioned forefoot portion of the sole, and further, which is of a form which possesses the same plane as the aforementioned ground contact plane.

Further, regarding an invention related to means for providing a reinforcing member to the forefoot in a continuous manner, Japanese Utility Model Laid-Open No. 6-24505, "Shoe soles for track-and-field sports" has been suggested.

This invention is comprised of a total of 3 claims, necessarily involving a reinforcing member comprised of a partition and concave portion which is formed from the thick forefoot portion toward the thin arch portion, the aforementioned thick forefoot portion being formed thickly so as to allow for fixing of spikes.

The bodily motion which served as a basis for the aforementioned invention, i.e., the state of the foot striking the ground is as follows; "When the runner first touches the ground with an extended foot, the lateral portion of the ball of the foot first touches the ground, from where a rolling motion takes place toward the medial ball portion of the foot, during which rolling motion of the foot, exertion is made to transfer the force of the leg directly to the ground, employing gripping elements which are fixed to the hard forefoot portion of the shoes." Accordingly, means have been provided so as to prevent dropping of the heel.

However, upon detailed analysis of bodily motion, it has been found that bodily motion exhibited is as shown in FIGS. 8A and B through FIGS. 13A and B.

As shown in FIG. 8, in the initial braking phase of the ground-striking phase, the region centered around the head of the second metatarsal first lands, and in the later half of this phase there is a rolling motion toward the lateral side so that the leading edge of the third phalanx contacts (1 through 15 of the stick diagrams of FIG. 8A), during which inverted motion a region surrounding the heads of the first through the third metatarsals contacts whereby there is a transition from the deceleration phase to the deceleration relaxing phase, and the heel region gradually descends toward the ground (16 through 22 of the stick diagrams of FIG. 9A).

Next, with further inversion, the entire region surrounding the heads of the first through the fourth metatarsals lands thereby introducing the phase of maximum load of body weight, wherein the heel region reaches the lowest position thereof toward the ground and the second deceleration phase occurs. However, the heel region does not contact even in this situation even though the entire area of the ball region and the forefoot portion has contacted (23 through 34 of the stick diagrams of FIG. 10A).

Subsequently, the body weight shifts to the entire area of the forefoot portion, and while the heel region rises, acceleration begins to affect the region surrounding the heads of the first through the fourth metatarsals along with the leading edge of the hallux, and acceleration in an upper and forward direction begins. The metatarsal region experiences the first acceleration stage while rolling from the lateral side to the medial side (35 through 59 of the stick diagrams of FIG. 11A). At this time, the metatarsal region remains in a state of dorsiflexion.

Next, while the heel region rises even further, the acceleration reaches maximum level, with the ball region, i.e., the region surrounding the heads of the first through the third metatarsals, and the leading edge of the hallux both still being in the state of being contacted, and the reaction force against the ground gradually decreases. In addition to the plantarflexion of the metatarsal region, plantarflexion in the region of the phalanxes also begins. She region in contact with the ground is gradually reduced to the side of the toes, bringing about the second acceleration phase (60 through 79 of the stick diagrams of FIG. 12A).

Next, the acceleration becomes greater than the upward reaction force against the ground, the region of the phalanxes also exhibits plantarflexion, and the toot leaves the ground. Finally, the head of the second metatarsal and then the leading edges of the first and third phalanxes leave the ground, making for the final acceleration phase (80 through 100 of the stick diagrams of FIG. 13A).

As described above, fast running is conducted by means of repeating the series of bodily motion& shown in the stick diagrams 1 of FIG. 8A through 100 of FIG. 13A as a single cycle. For example, in the 100 meter race, 80% is the acceleration stage, thereby necessitating maximal avoidance of descent of the heel region toward the ground which begins from the latter half of FIG. 8A, and the phenomena of further descent of the heel which occurs at the mid-stage of deceleration shown in 16 of FIG. 9A through 34 of FIG. 10A (deceleration relaxing phase, second deceleration phase), as well as allowing for smooth rolling of the foot so as to prevent decrease in effective fast running.

However, the "wedge-shaped reinforcing member" in the aforementioned Japanese Patent Publication No. 5-72801 is formed of a material which is elastically deformable by pressure, so that deformation may occur due to pressure of striking the ground. Further, since the "wedge-shaped reinforcing member" touches the entire width of the rear edge and is extended from the rear edge to the middle of the arch area, there has been a disadvantage wherein the medial portion and the lateral portion of the "wedge-shaped reinforcing member" come in contact with the ground in the initial stage of landing, thereby increasing the time period of deceleration in the landing action, and obstructing effective fast running.

Further, the "reinforcing member comprised of a partition and concave portion" described in the latter Japanese Patent Laid-Open 6- 24505 is only a member to fill in the difference in height between the forefoot portion and the arch portion, and serves no purpose in preventing the descent of the heel portion.

SUMMARY OF THE INVENTION

Accordingly, in order to solve the aforementioned problems, the present invention provides a shoe sole for running shoes, comprised of a ball region of the forefoot portion which is thickly formed so as to allow for fixing of spikes, wherein as reinforcing member is provided to the ball region of the shoe sole, so as to form the region between the ground contact plane which is the same as the forefoot portion, and wherein a lateral rib and a medial rib are provided to the arch region, the lateral rib and medial rib possessing a gradual inclined plane, the range thereof beginning from the rear edge portion of the reinforcing member to the front edge portion of the heel region. Descent of the heel at the time of landing can be inhibited by means of the reinforcing member and lateral rib and medial rib. Rolling motion from the lateral side portion and the medial side portion of the foot to its toe region can be made effective.

Since the sole of the present invention has been made to be of the aforementioned construction, the following operation is exhibited in the event that the present invention is used in sprint events: i.e., at the time in fast running when the foot lands, experiencing the initial deceleration phase to the deceleration relaxing stage, wherein there is the second deceleration stage in which the greatest load phase of bodily weight occurs and the heel region descent toward the ground at a maximum degree, the reinforcing member provided to the ball region of the shoe sole so as to form the ground contact plane which is the same as the forefoot portion, and the lateral rib and medial rib provided to the arch region, come in contact with the ground and control the descent of the heel region and encourage smooth rolling of the shoe sole, so that the phenomena of the heel descent is maximally avoided. In shifting to the acceleration phase, in the first acceleration phase, second acceleration phase, and final acceleration phase, the lateral rib and the medial rib operate to demonstrate effective rolling of the foot from its lateral side to the medial side and then to its toe.

DESCRIPTION OF THE PREFERRED EMBODIMENT

The following description of the invention will be made with reference to the Figures.

A running shoe according to the present invention comprises an integrally formed shoe sole (2) comprised of a forefoot portion (A) which is thickly formed so as to allow for fixing of spikes, using an arbitrary synthetic resin which is of a relatively hard nature, such as polyamide (nylon) or polyurethane, a ball region (B), an arch region (C), and a heel region (D); and an upper comprised of leather, artificial leather, fabric, knit material, or other material of similar effect; the shoe sole and the upper being integrally formed by means of adhesion so as to form this running shoe;

Spikes (3) and protrusions (11) are provided to the anterior region of the ball region (B) of the aforementioned shoe sole (2), and a reinforcing member (4) is provided to the rear of the ball region (B), so as to fill the region between the ground contact plane (F) which is the same as the forefoot portion (A), and the bottom surface (G) of the last (H).

Figure 10A:
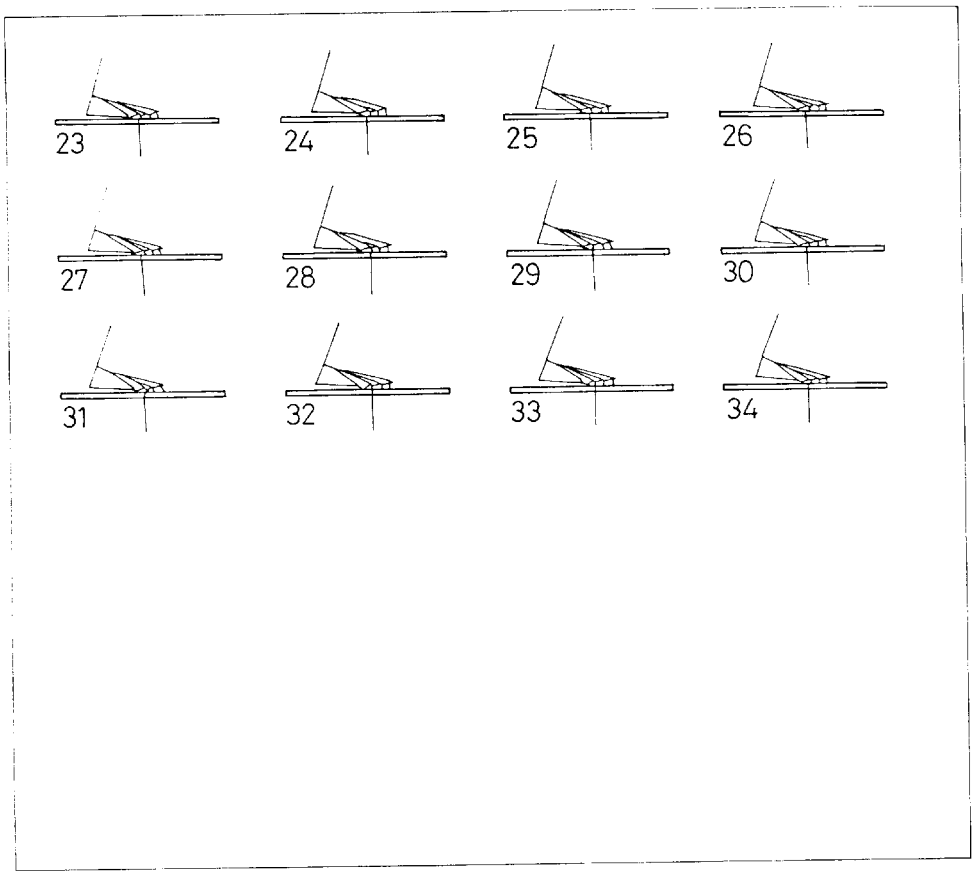
FIG. 10A shows stick diagrams analyzing the landing state of the foot in the second deceleration phase during fast-running for short-distance.
Figure 10B:
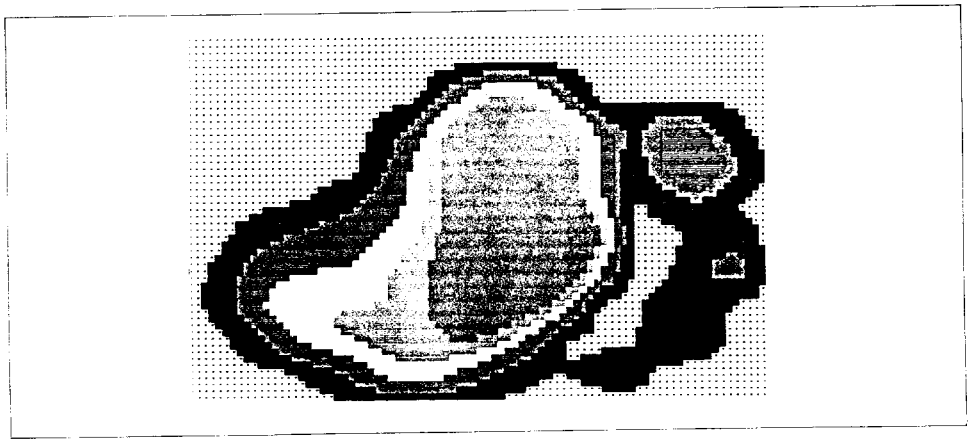
FIG. 10B is a diagram showing the state of the plantar of the foot in contact with the ground at that time.
Figure 11A:
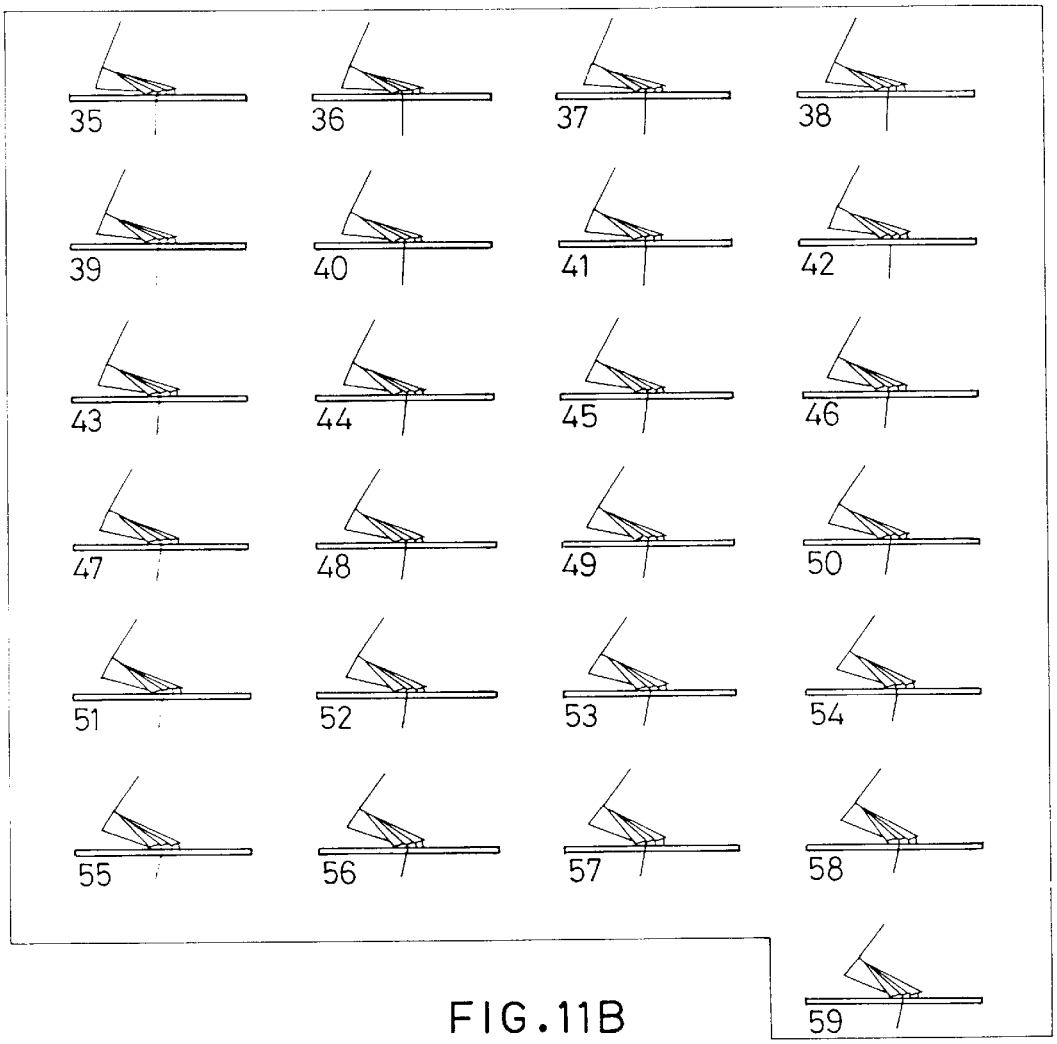
FIG. 11A shows stick diagrams analyzing the landing state of the foot in the first acceleration phase during fast running for short-distance.
Figure 11B:
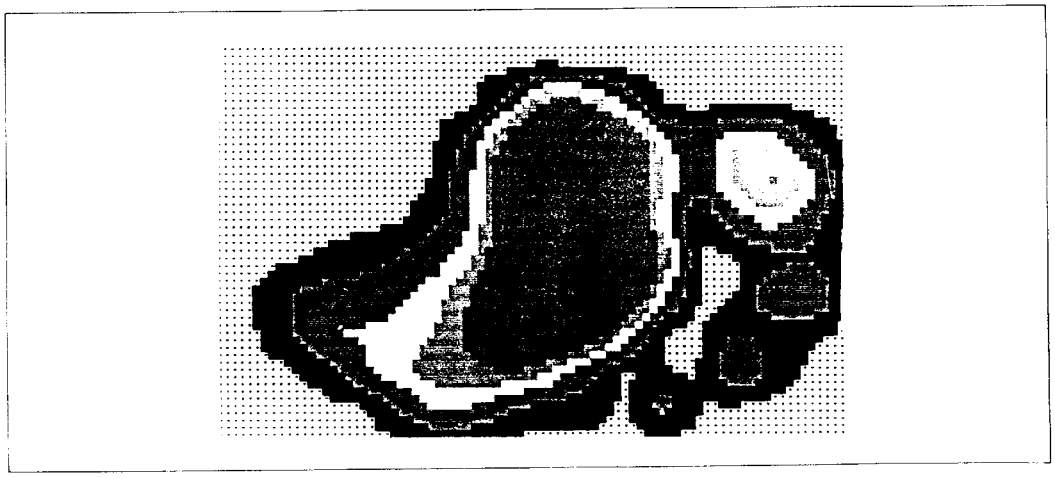
FIG. 11B is a diagram showing the state of the plantar of the foot in contact with the ground at that time.
Figure 12A:
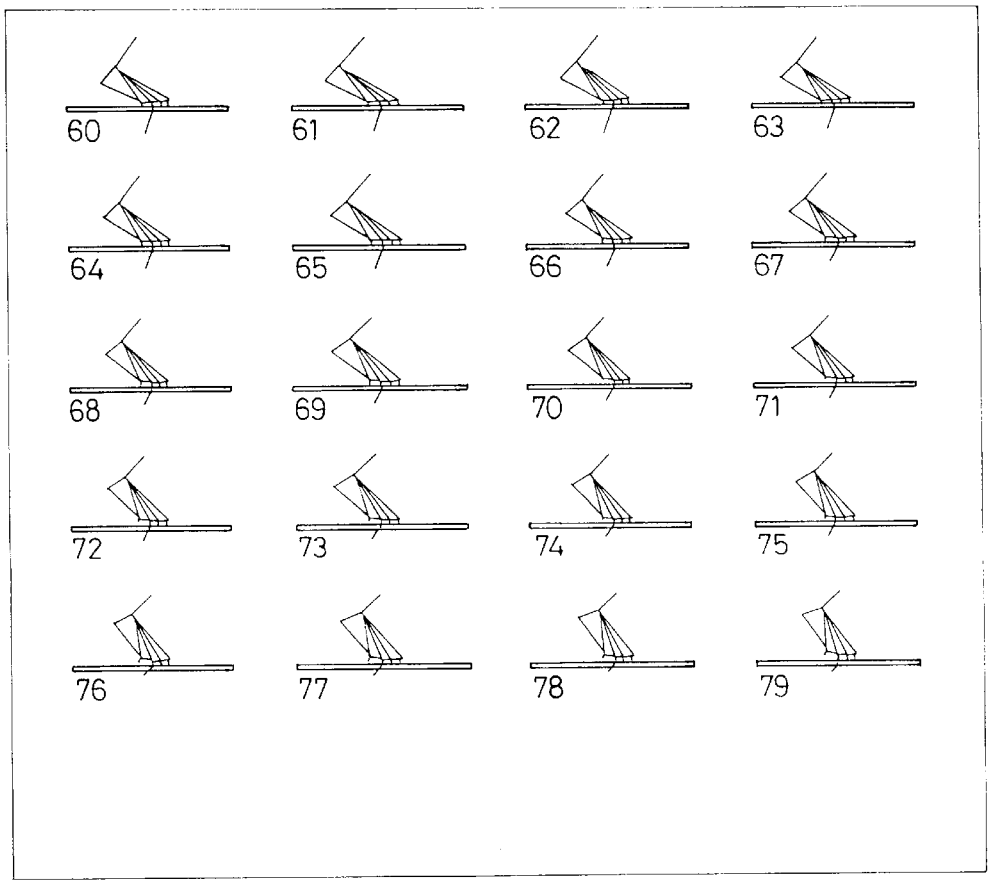
FIG. 12A shows stick diagrams analyzing the landing state of the foot In the second acceleration phase during fast running for short-distance.
Figure 12B:
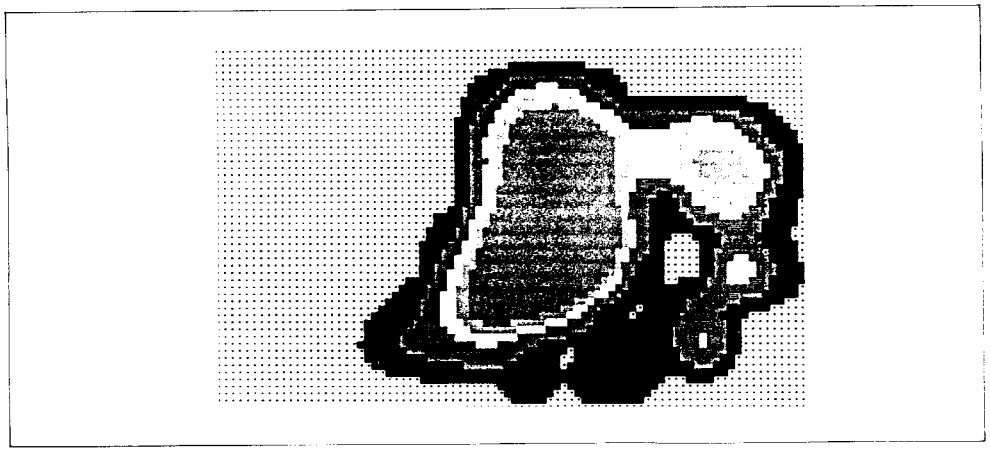
FIG. 12B is a diagram showing the state of the plantar of the foot in contact with the ground at that time.
Figure 13A:
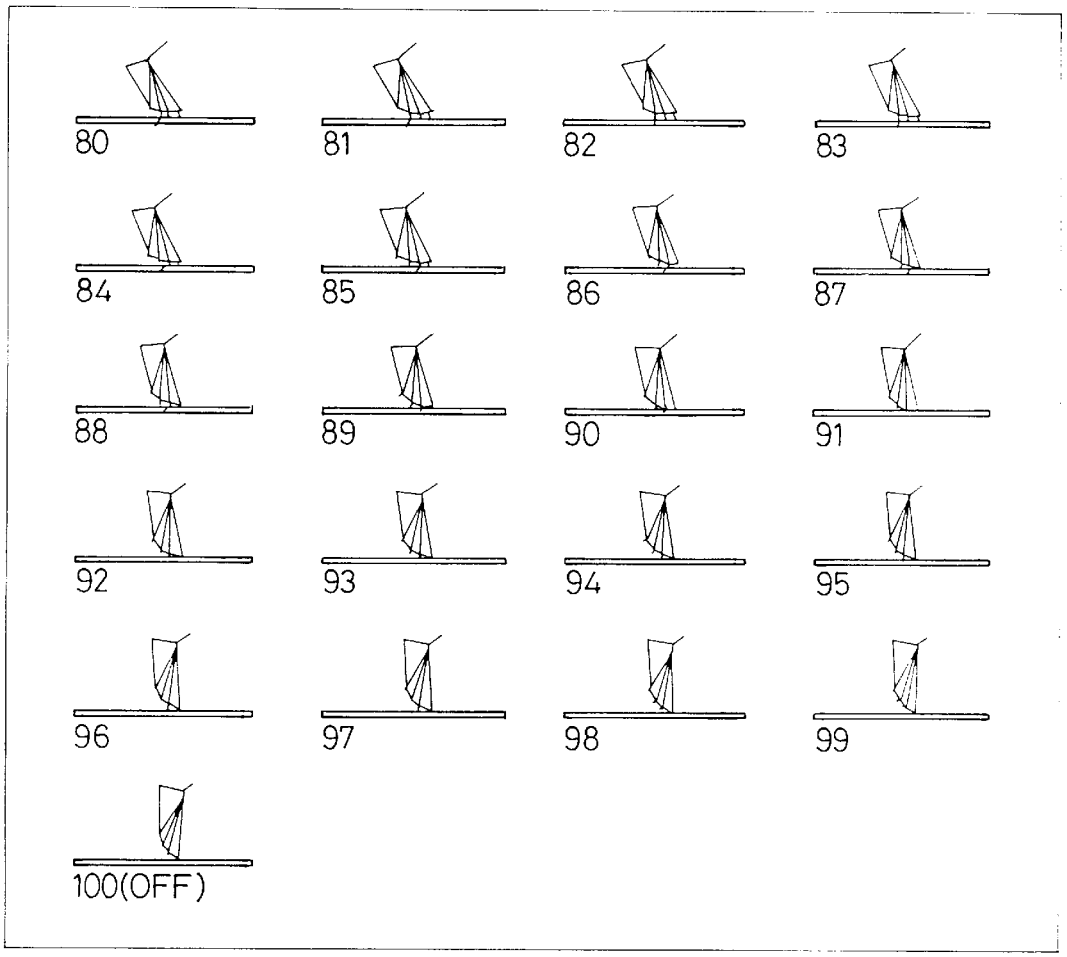
FIG. 13A shows stick diagrams analyzing the landing state of the foot in the final acceleration phase during fast running for short-distance.
Figure 13B:
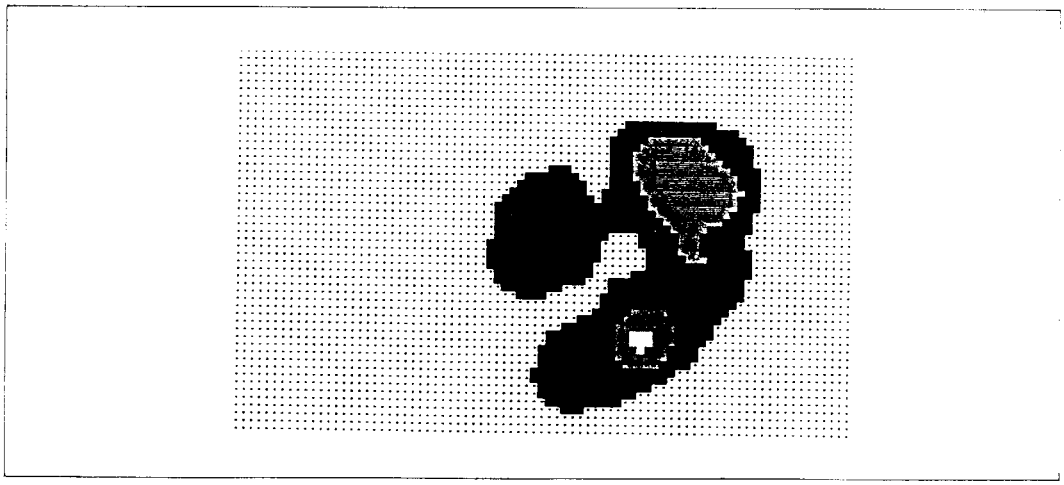
FIG. 13B is a diagram showing the state of the sale of the foot in contact with the ground at that time.
Figure 14:
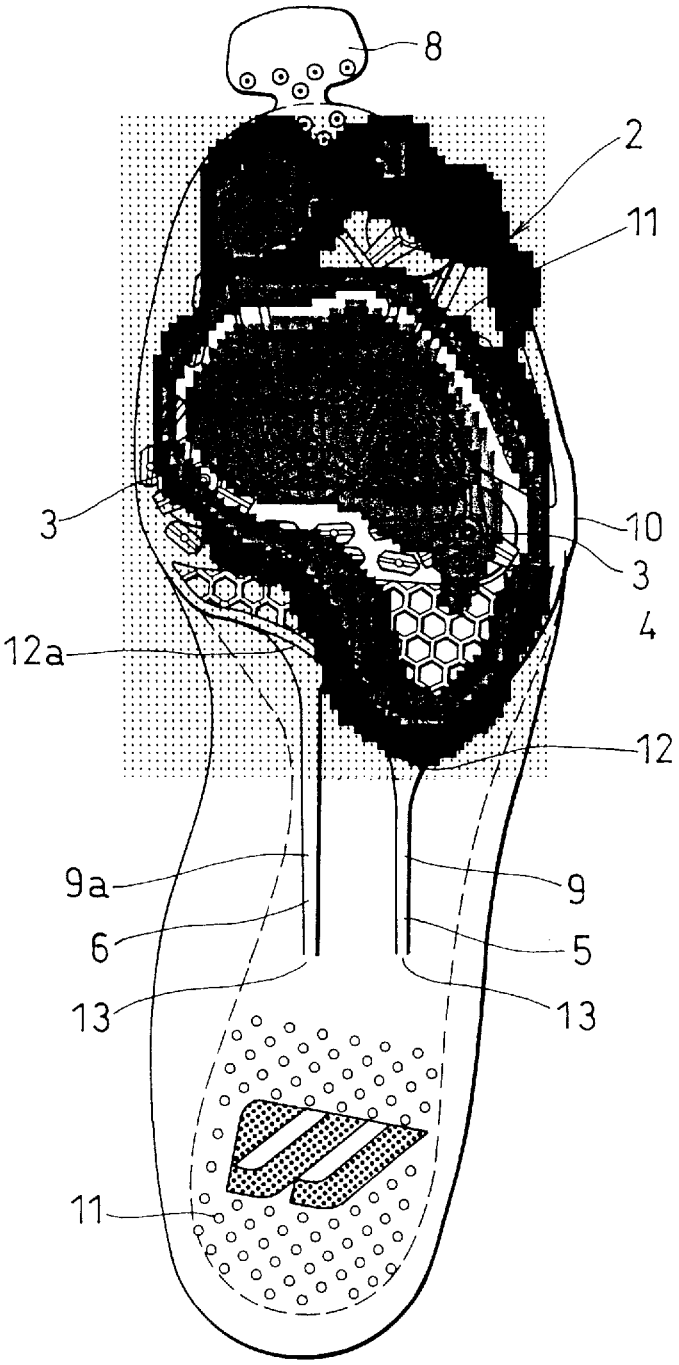
FIG. 14 shows the relation between the state of the plantar of the foot in contact with the ground during the second deceleration phase shown in FIG. 10B, and a shoe sole.

As shown in FIG. 14, the plane form of this reinforcing member (4) should be of the same form as the state of the plantar of the foot in contact with the ground during the second deceleration phase shown in the aforementioned FIG. 10B. This reinforcing member (4) may be formed so as to be partitions (14) defining an aforementioned honeycomb concave-convex portions (7) or any arbitrary form, including a lattice or the like (not shown).

Next, a lateral rib (5) and a medial rib (6) are provided to the aforementioned arch region (C), the lateral rib possessing a gradually inclined plane (9), the range thereof beginning from the rear edge portion (12) of the reinforcing member (4) provided to the ball region (B) and extending to the front edge portion (13) of the heel region (D), and the medial rib possessing a gradually inclined plane (9*a*), the range thereof beginning from the rear edge portion (12*a*) of the reinforcing member (4) provided to the aforementioned ball region (B) and extending to the front edge portion (13) of the aforementioned heel region (D), thereby forming the sole (2) of the running shoe.

Figure 1:
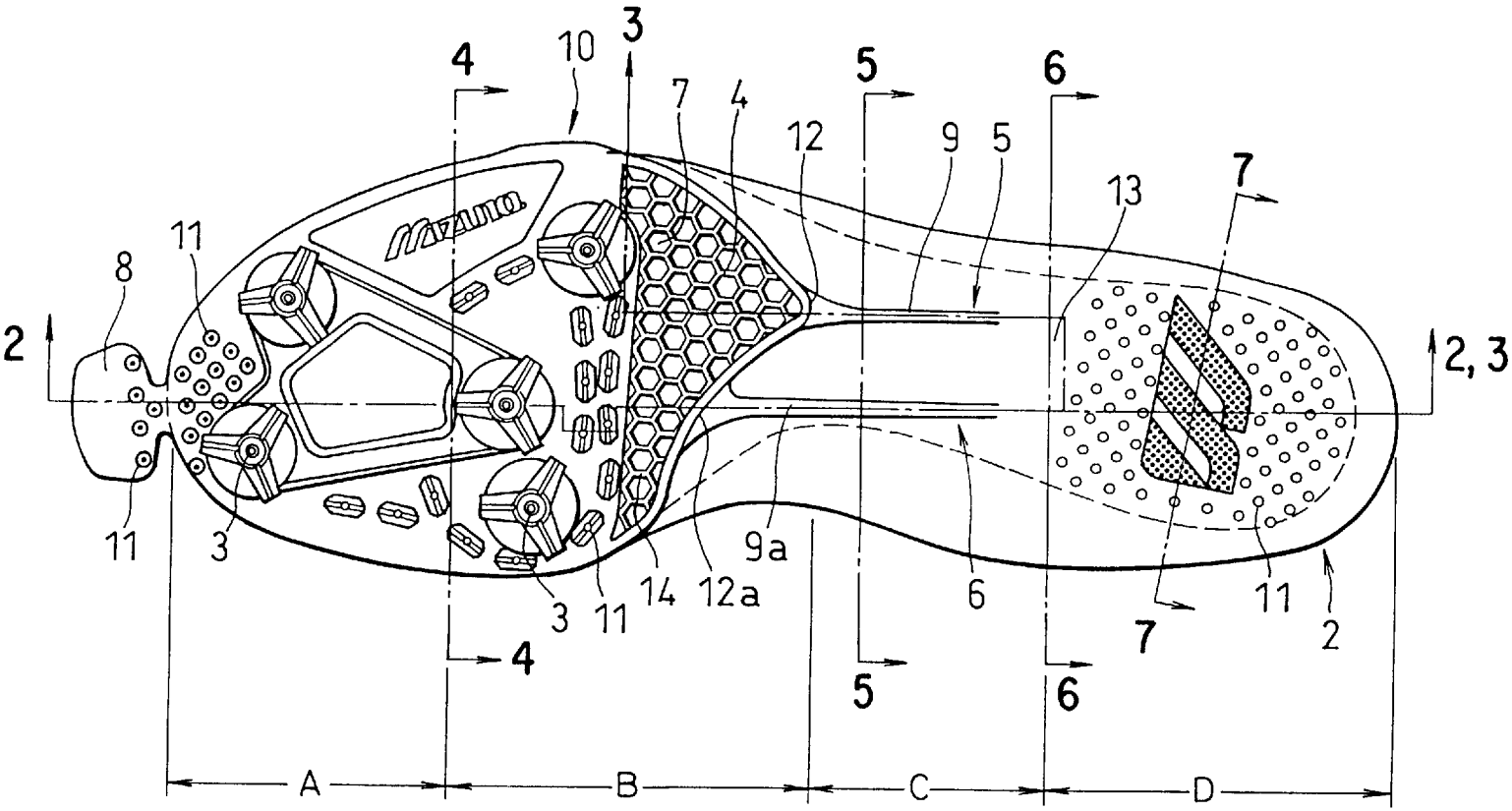
FIG. 1 is a plan drawing of a sole of a running shoe in the event that the present invention is used for the left foot.
Figure 2:
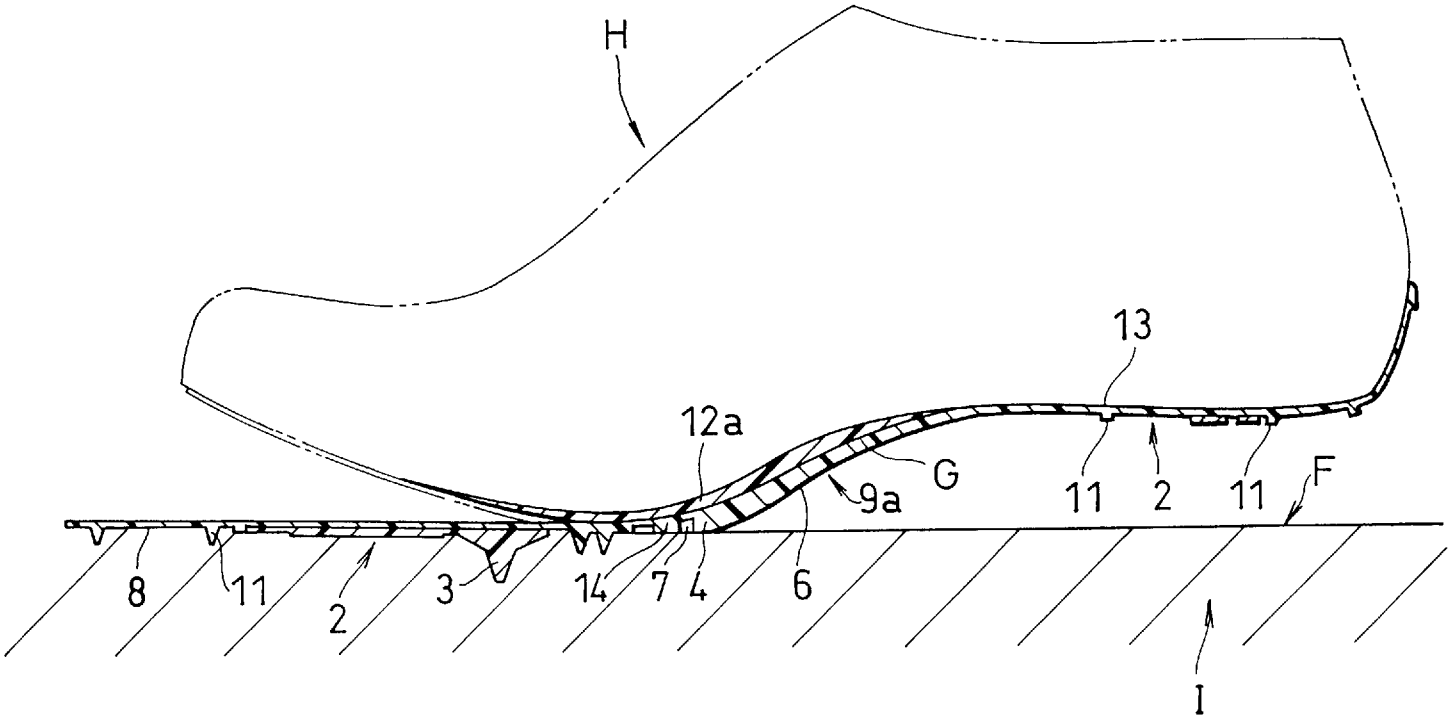
FIG. 2 is a cross-sectional view taken along the line 2—2 in FIG. 1.
Figure 3:
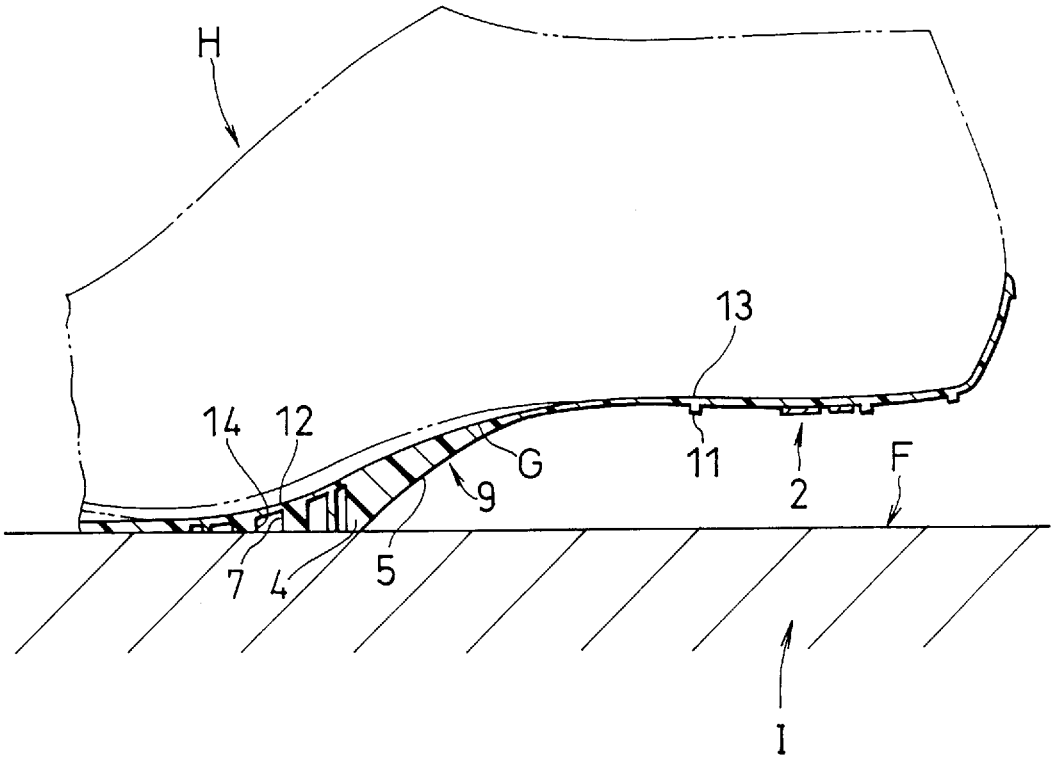
FIG. 3 is a cross-sectional view taken along the line 3—3 in FIG. 1.
Figure 4:
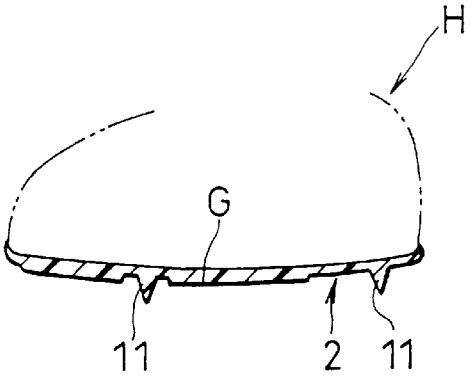
FIG. 4 is a cross-sectional view taken along the line 4—4 in FIG. 1.
Figure 5A:
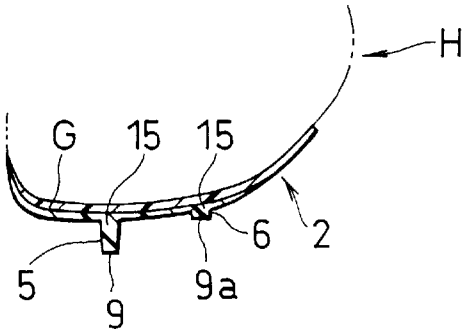
FIGS. 5A and B are a cross-sectional views taken along the line 5—5 in FIG. 1.
Figure 5B:
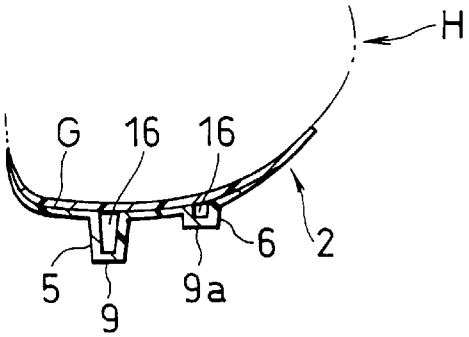
Figure 6:
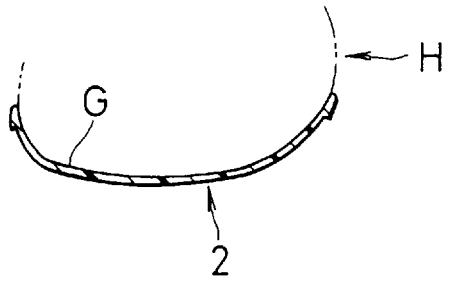
FIG. 6 is a cross-sectional view taken along the line 6—6 in FIG. 1.
Figure 7:
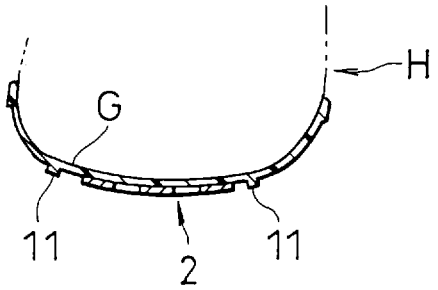
FIG. 7 is a cross-sectional view taken along the line 7—7 in FIG. 1.
Figure 8A:
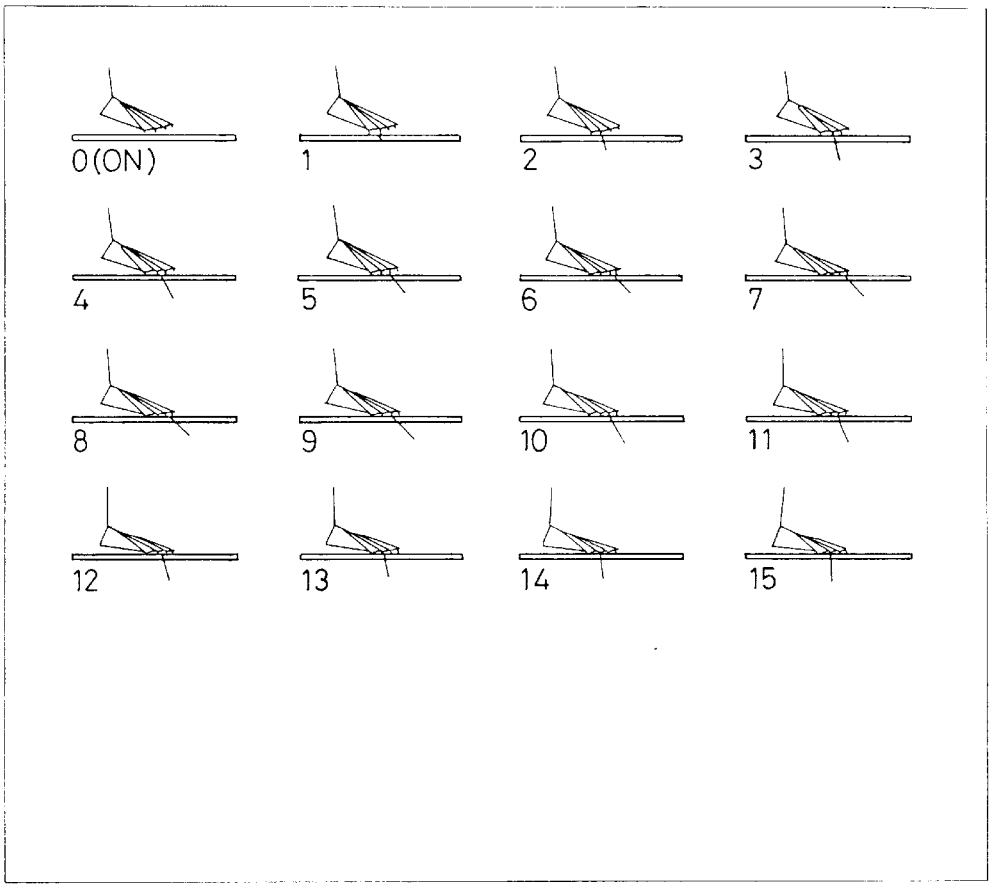
FIG. 8A shows stick diagrams analyzing the landing state of the foot in the initial deceleration phase during fast running for short-distance.
Figure 8B:
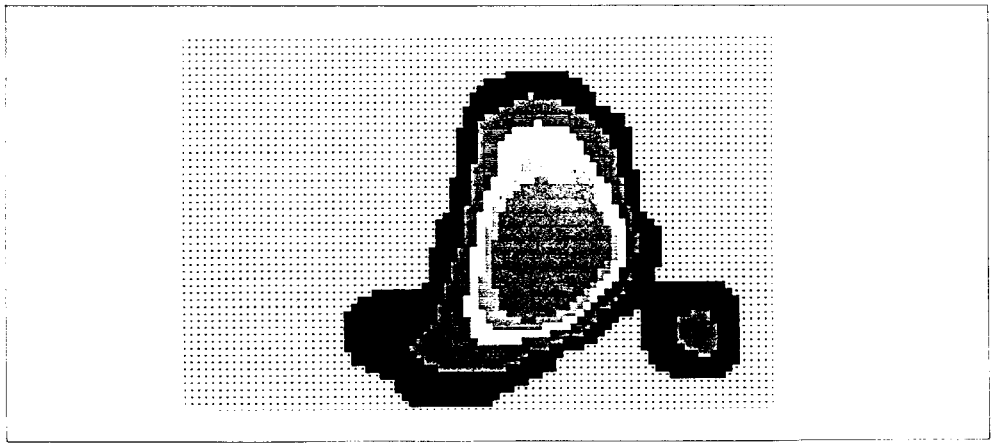
FIG. 8B is a diagram showing the state of the plantar of the foot in contact with the ground at that time.
Figure 9A:
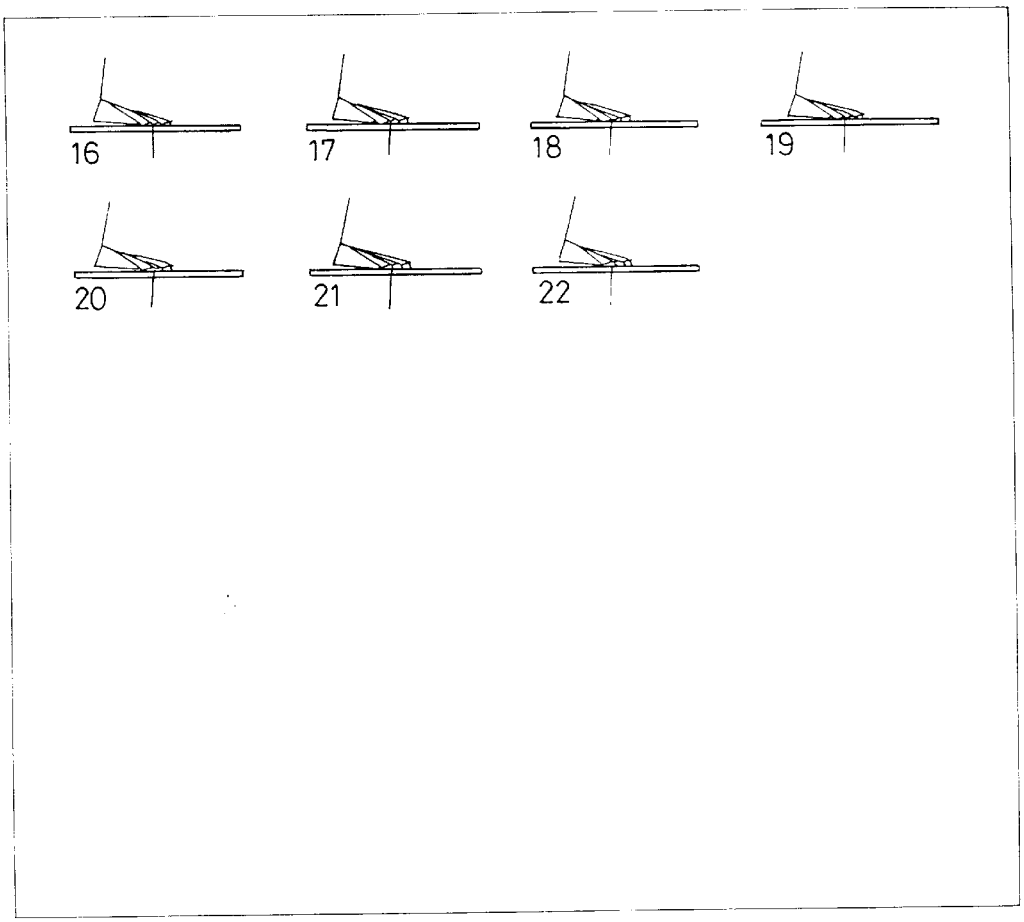
FIG. 9A shows stick diagrams analyzing the landing state of the foot in the deceleration relaxing phase during fast running for short-distance.
Figure 9B:
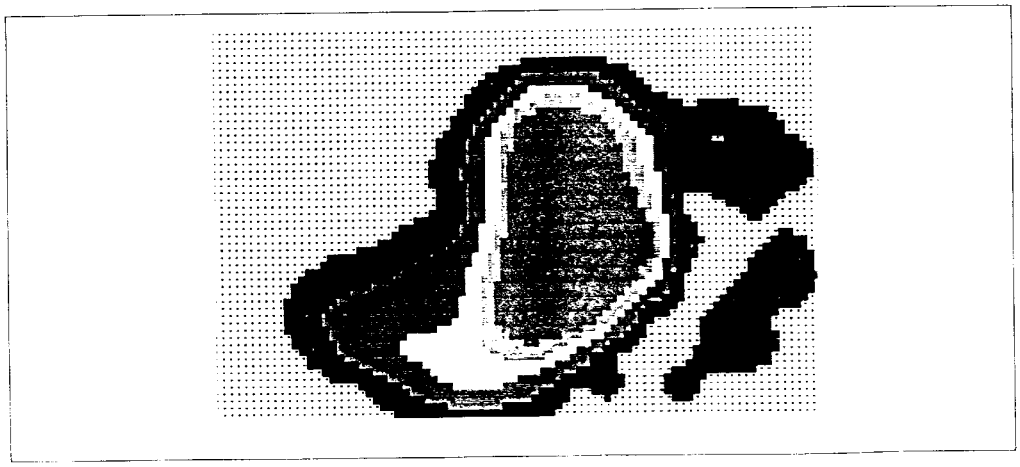
FIG. 9B is a diagram showing the state of the plantar of the foot in contact with the ground at that time.

It is desirable that the arrangement of the plantar of the foot and the shoe sole be as shown in FIG. 14. This lateral rib (5) and medial rib (6) may either be of a solid construction (15) or a hollow construction (16), as shown in FIGS. 5A and B.

Spikes (3) are provided to the forward portion of the ball region (B) and the forefoot portion (A), in an arbitrary configuration. In the event that the spikes (3) are to be exchangeable, replacement nuts are embedded within the shoe sole (2) (Illustration omitted). Or, if the spikes are to be fixed, their flanges are embedded within the shoe sole (2) (Illustration omitted).

Further, protrusions (11) of an arbitrary arrangement are provided to the forefoot portion (A), the ball region (B), and the heel region (D). It in desirable that the protrusions (11) be formed integrally with the shoe sole (2).

Moreover, providing a member to wrap up over the toe (8) to the anterior toe portion of the forefoot portion (A), and a member to wrap up over the side (10) to the lateral side of the ball region (B) can be done arbitrarily as desired.

Effects of the Present Invention

Since the sole of the present invention has been made to be of the aforementioned construction, the following operation is exhibited in the event that the shoe with the sole of present invention is used in sprint events: i.e., at the time in fast running when the foot lands, experiencing the initial deceleration phase to the deceleration relaxing stage, wherein there is the second deceleration stage in which the greatest load phase of bodily weight occurs and the heel region descents toward the ground at a maximum degree, the reinforcing member provided to the ball region of the shoe sole so as to form the ground contact plane which is the same as the forefoot portion, and the lateral rib and medial rib provided to the arch region, come in contact with the ground and control the descent of the heel region, and take the load of body weight so as to prevent deforming of the shoe sole and to encourage smooth rolling of the shoe sole, so that decrease in the efficiency of fast running during the deceleration phase is prevented.

Next, in shifting to the acceleration phase, regarding the reinforcing member and the lateral rib and medial rib provided to the arch region continuously with the aforementioned reinforcing member, in the first acceleration phase, second acceleration phase, and final acceleration phase occurring, the lateral rib and the medial rib operate to demonstrate effective rolling of the foot from its lateral side to the medial side and then to the toe region, so that decrease in the efficiency of fast running is prevented.

I claim:

1. A running shoe comprising:

an integrally formed shoe sole of a synthetic resin of a relatively hard nature, having a forefoot portion, a ball region, an arch region, and a heel regions, said forefoot portion and said ball region including spikes fixed thereto;

an upper to which said shoe sole is integrally secured by adhesion;

a reinforcing member formed in the ball region of said shoe sole so as to form a ground contact plane which is the same as the ground contact plane of the forefoot portion so as to prevent deforming of the shoe sole and encouraging a smooth rolling of the shoe sole; and lateral and medial ribs formed in said arch region, the lateral rib defining a gradually inclined plane and extending from a rear edge portion of the reinforcing member to a front edge portion of said heel region, the medial rib defining a gradually inclined plane and extending from the rear edge portion of the reinforcing member to the front edge portion of said heel region.

2. A running shoe according to claim 1, wherein the reinforcing member formed in the ball region possesses partition walls defining honeycomb portions.

3. A running shoe according to claim 2, wherein each of the lateral and medial ribs formed in said arch region comprises a solid structure.

4. A running shoe according to claim 2, wherein each of the lateral and medial ribs formed in said arch region comprises a hollow structure.

5. A running shoe according to claim 1, wherein the reinforcing member formed in the ball region possesses partition walls defining a lattice.

6. A running shoe according to claim 5, wherein each of the lateral and medial ribs formed in said arch region comprises a solid structure.

7. A running shoe according to claim 5, wherein each of the lateral and medial ribs formed in said arch region comprises a hollow structure.

8. A running shoe according to claim 1, wherein each of the lateral and medial ribs formed in said arch region comprises a solid structure.

9. A running shoe according to claim 1, wherein each of the lateral and medial ribs formed in said arch region comprises a hollow structure.

* * * * *